US007137337B2

(12) United States Patent
Bonella

(10) Patent No.: US 7,137,337 B2
(45) Date of Patent: Nov. 21, 2006

(54) PROCESS FOR THE PRODUCTION OF CARDS WITH IMAGES AND RELATIVE IMAGE CARD

(75) Inventor: Andrea Bonella, Battaglia (IT)

(73) Assignee: Fratelli Bonella Srl, Milan (IT)

( * ) Notice: Subject to any disclaimer, the term of this patent is extended or adjusted under 35 U.S.C. 154(b) by 0 days.

(21) Appl. No.: 10/820,970

(22) Filed: Apr. 7, 2004

(65) Prior Publication Data

US 2005/0016404 A1 Jan. 27, 2005

(30) Foreign Application Priority Data

Jul. 21, 2003 (IT) ..... MI2003A1481

(51) Int. Cl.
*B41F 33/00* (2006.01)

(52) U.S. Cl. ..... 101/483; 101/34; 101/487

(58) Field of Classification Search ..... 101/483, 101/484, 150, 487, 33, 34; 283/75, 77; 344/224
See application file for complete search history.

(56) References Cited

U.S. PATENT DOCUMENTS 3,655,494 A * 4/1972 Buzzell ..... 430/10
4,536,013 A * 8/1985 Haghiri-Therani et al. ... 283/77
4,748,452 A * 5/1988 Maurer ..... 347/224
4,773,677 A * 9/1988 Plasse ..... 283/77
5,695,589 A * 12/1997 German et al. ..... 156/250
5,895,074 A * 4/1999 Chess et al. ..... 283/75
6,210,777 B1 * 4/2001 Vermeulen et al. ..... 428/195.1
6,494,490 B1 * 12/2002 Trantoul ..... 283/91
6,621,524 B1 * 9/2003 Yamamoto et al. ..... 348/584
2003/0183695 A1 * 10/2003 Labrec et al. ..... 235/487
2003/0218663 A1 * 11/2003 Baxter et al. ..... 347/102
2004/0050269 A1 * 3/2004 Adamczyk et al. ..... 101/150

* cited by examiner

*Primary Examiner*—Ren Yan
(74) *Attorney, Agent, or Firm*—Darby & Darby

(57) ABSTRACT

A process for the production of image cards including printing of a sheet so as to obtain a printed sheet with a plurality of images disposed in a plurality of windows, overprinting of decorations on said image windows, deposition of a protective layer on said decorations so as to fix them and avoid removal of the material from the decorations and punching of said printed sheet so as to obtain a punched sheet with microperforations along the perimeter of said windows containing the image.

11 Claims, 2 Drawing Sheets

PROCESS FOR THE PRODUCTION OF CARDS WITH IMAGES AND RELATIVE IMAGE CARD

BACKGROUND OF THE INVENTION

1. Field of the Invention

The present invention refers to a process for the production of cards with images and to a relative image card.

2. Description of Related Art

As is known, there are available on the market various types of cards, generally of paper or cardboard, which depict various types of images, generally holy images. Such a type of image card is commonly known as a holy card.

On the back of the holy card there are generally reproduced words related to the image shown and personalised according to the use of the holy card.

For production of holy cards use is generally made of a large-sized sheet on which a number of windows with the image to be depicted are printed, generally by offset printing. The sheet is subsequently sent to a punch cutter which microperforates the sheet along the perimeter of the image windows by means of suitable punches.

Said printed, microperforated sheets are subsequently sent to special printing machines, such as photocopiers or dot impact printers or inkjet printers which print the customised wording on the back of each holy card. Lastly, the holy cards are separated from each by breaking the perforated strips.

Furthermore, there exist on the market holy cards which, after offset printing, are coated by hot overprinting, for example in the background and the outlines of the image, with a decorative layer containing pigments of noble metals, such as gold, silver and the like.

These hot-decorated holy cards present the drawback that the decorative layer does not fix well to the offset print of the holy card and therefore if the decorative layer is subjected to heat or friction, small fragments thereof tend to become detached. As a result, if a sheet treated with this decorative layer is inserted in a laser printer or a photocopier for the writing on the back of the holy card, the heat of the machine and rubbing with the rollers of the printing machine would tend to detach some fragments of the decorative layer which would foul the printing rollers, damaging the machine.

For this reason perforated sheets bearing a plurality of holy cards coated with a decorative layer do not exist on the market. In fact, holy cards with a decorative layer are produced individually, so as to be able to be printed on the back, without having to pass between the printing rollers, but for example by means of pressure printing between plates.

SUMMARY OF THE INVENTION

The object of the present invention is to eliminate the drawbacks of the prior art by providing a process for the production of cards with an image, coated with a decorative layer, that is efficient, effective, cheap and simple to accomplish.

Another object of the present invention is to provide such a method that allows excellent stabilization of the decorative layer, completely eliminating the risk of damaging the machine that prints on the back of said cards with image.

Another object of the present invention is that of providing a sheet comprising a plurality of cards able to be inserted in a roller printer for printing on the back.

Another object of the present invention is to provide an image card that has a considerable aesthetic appearance and at the same time can be personalised with writing on the back.

The process for producing image cards according to the invention comprises the following steps:

- printing of a sheet, so as to obtain a printed sheet with a plurality of images disposed in a plurality of windows, and
- punching of said printed sheet so as to obtain a punched sheet with microperforations along the perimeter of the windows containing the image.

The main characteristic of the process according to the invention is represented by the fact that it further comprises the steps of:

- overprinting decorations on the image windows, and
- depositing a protective layer on the decorations so as to fix them and avoid removal of the material of the decorations.

Said method allows a sheet of image cards to be obtained, suitable to be inserted in a roller printer without the problem of fouling the printing rollers.

BRIEF DESCRIPTION OF THE DRAWINGS

Further characteristics of the invention will be made clearer by the detailed description that follows, referring to a purely exemplary and therefore non limiting embodiment thereof, illustrated in the appended drawings, in which.

DESCRIPTION OF EMBODIMENTS OF THE INVENTION

The production process for image cards according to the invention is described with the aid of the figures.

Figure 1A:
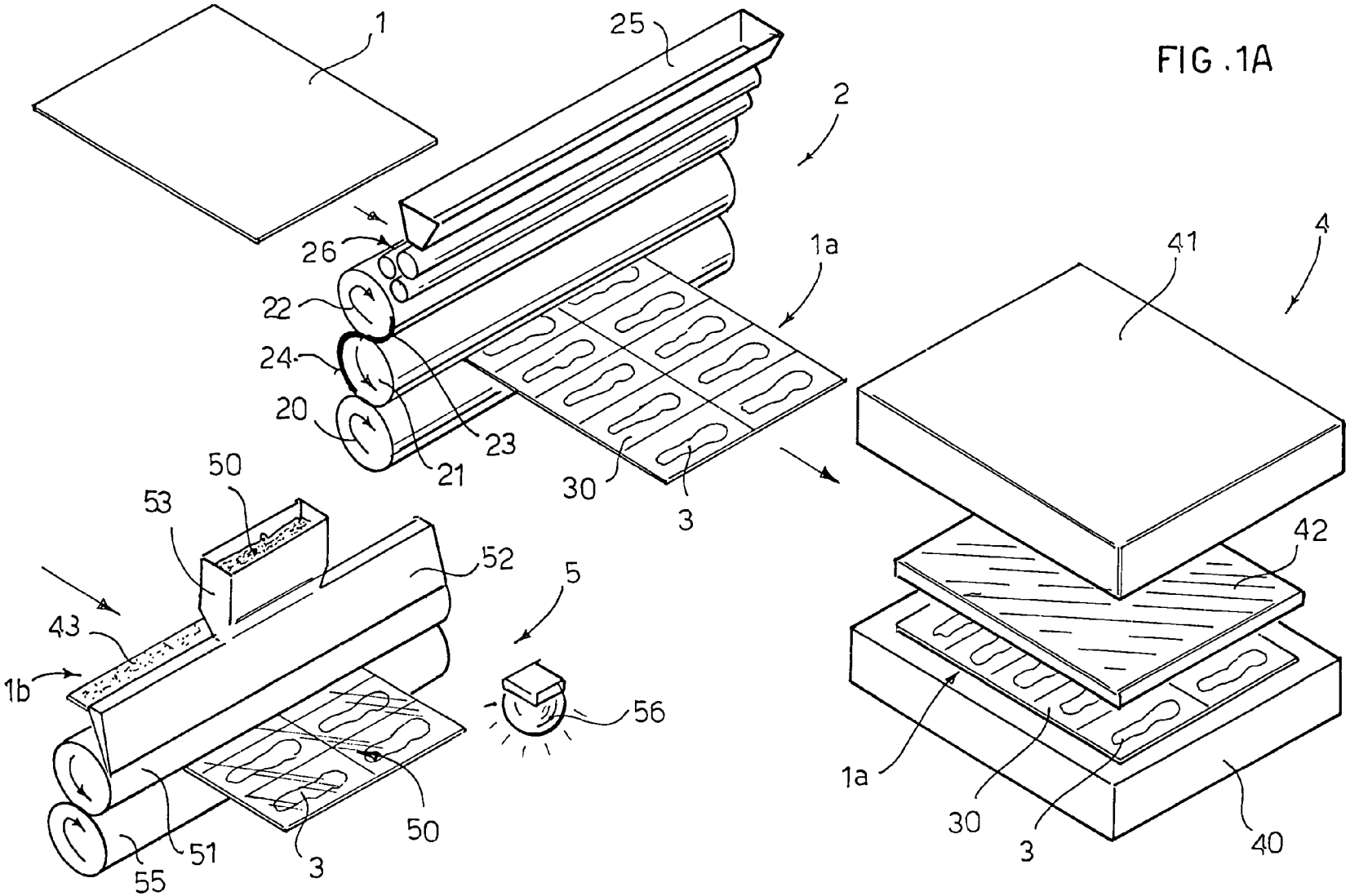
FIG. 1A is a diagrammatic perspective view illustrating the initial stages of the production process of the holy cards according to the invention.

With reference for now to FIG. 1A, a plain sheet 1 of paper or card, substantially rectangular in shape, is fed towards an offset printing press 2. The offset printing press 2 comprises a set of three rollers: print backup roller 20, rubber roller 21 and plate roller 22.

In the plate roller 22 there is mounted a zinc plate 23 whereon there is impressed the image to be transferred, by means of a photochemical process, through a photosensitive film. The colour is transferred to the plate 23 by means of an inking assembly comprising an ink fountain 25 and an inking roller assembly 26.

The ink is transferred, by means of pressure, from the plate 23 to an area 24 of the rubber roller 21. The ink is then transferred, by means of pressure, from the inked area 24 of the rubber roller 21 to the plain sheet 1 which is fed between the print backup roller 20 and the rubber roller 21.

In this manner a sheet 1*a* is obtained on the front surface of which there is impressed a plurality of images 3 disposed in respective windows 30.

The sheet 1*a* with the printed images 3 is fed towards a hot printing press 4 which comprises a base plate 40 and a heating plate 41 heat-regulated by means of electrical resistances. In the bottom surface of the heat-regulated plate 41 there is inserted a printing plate in which the parts in which transfer of material must occur are reproduced in relief.

The printed sheet 1*a* is positioned on the base plate 40. Between the printed sheet 1*a* and the heat-regulated plate 41 there is fed a hot printing foil 42 comprising a polyester film substrate whereon are applied metallized flakes or pigments, in particular with noble metals such as gold, silver or the like, or pastel-coloured pigments, or coloured pigments in waxy solutions. For simplicity's sake, reference will be made herein to a gold decorative layer.

The base plate 40 is brought under pressure onto the heat-regulated plate 41, suitably heated by means of resistances, so as to press the decorative foil 42 onto the front surface of the sheet 1*a*.

As a result the gold pigments of the foil 42 are transferred by hot pressure onto the windows 30 of the printed sheet 1*a*, for example by coating the background and the outlines of each image 3. In this manner a decorated sheet 1*b* is obtained which provides a plurality of windows with images 3, decorated by means of an overprinted decoration 43.

Subsequently, the decorated sheet 1*b* is sent to a coating unit 5 able to deposit a protective coating on the decorated sheet 1*b* which tends to fix the decorations 43.

As shown in FIG. 1A, the coating station 5 can have a varnishing machine comprising:

a feed roller 55 to feed the sheet 1*b*, a spreader roller 51, able to deposit a transparent protective varnish 50 on the front surface of the sheet 1*b*, and a doctor blade 52 to spread the protective varnish 50 contained in a tank 53 evenly over the surface of the spreading roller 51.

Obviously, instead of the varnishing assembly described above, other means can be used for depositing the varnish 50, such as sprayers, brushes, doctor blades, rollers and the like.

The transparent protective varnish 50 deposited on the sheet 1*b* is dried by means of ultraviolet (UV) lamps 56.

The function of said process of coating with a UV-dried transparent varnish is to polish and/or protect the decorated sheet 1*b*.

In place of the protective varnish 50, the front surface of the decorated sheet 1*b* can be coated with a thin film of transparent plastic material, which tends to retain the pigments of the decorative layer 43.

Figure 1B:
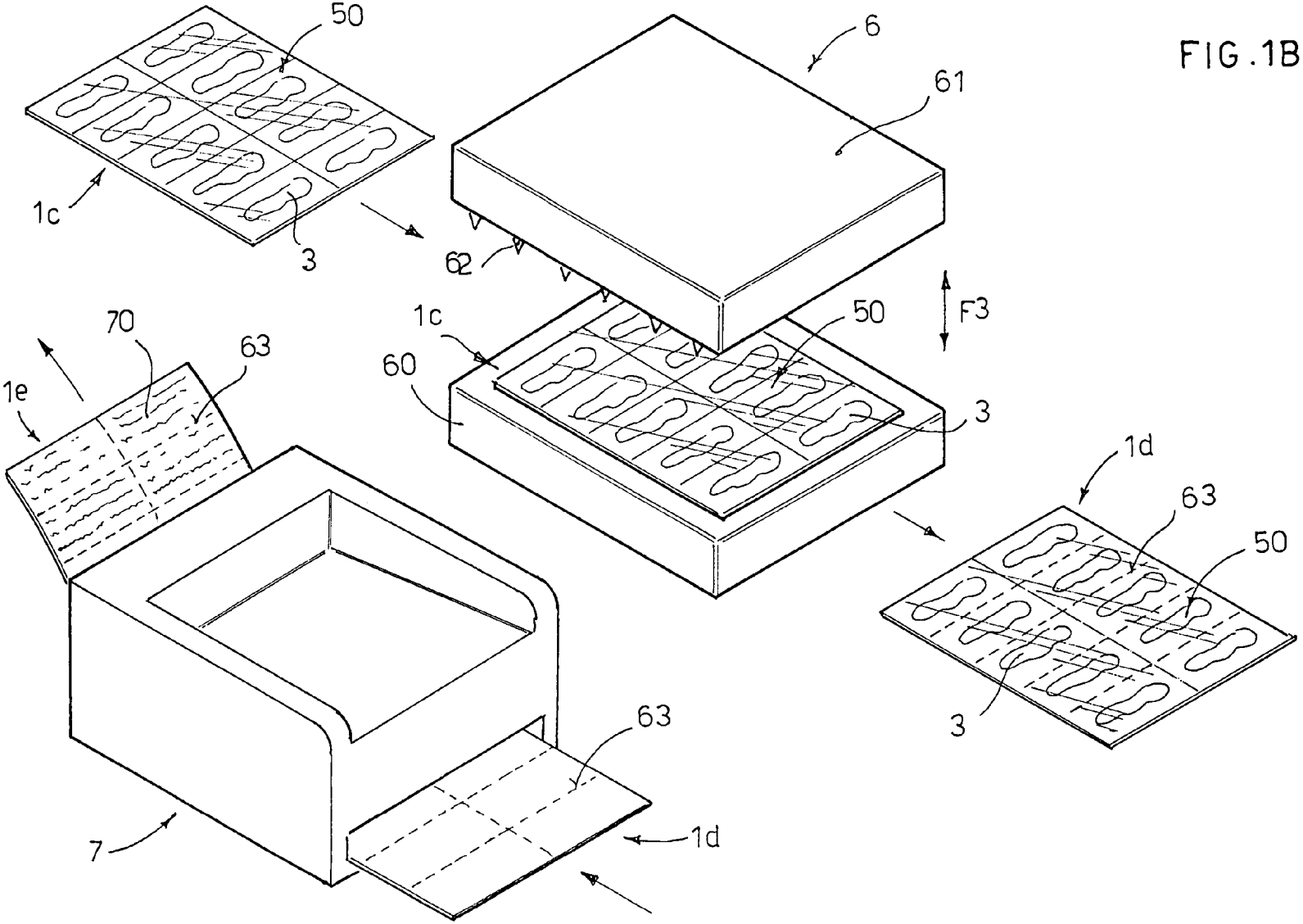
FIG. 1B is a diagrammatic view like FIG. 1A illustrating the final stages of the production process of the holy cards according to the invention.

As shown in FIG. 1B, at the end of the protection process a sheet 1*c* is obtained which has a protective surface layer 50 which tends to fix the decorations 43.

Said sheet 1*c* is sent to a punching machine 6 which comprises a base plate 60 and a movable top plate 61 which moves vertically with a reciprocating movement in the direction of the arrow F3.

The movable top plate 61 has a plurality of punches 62 arranged in a row and column fascion able to generate microperforations along the edges of the windows 30, on the sheet 1*c* which is positioned on the base surface 60.

Leaving the punching machine 6 a sheet 1*d* is obtained with microperforations 63 arranged along the perimeter of the windows which contain the various images 3. The sheet 1*d*, printed, decorated, protected and perforated is ready to be sent for storage or packaging so that it can be put on the market.

The various sheets 1*d* can be sold to different users having different requirements for customization of the holy cards. Consequently, each user sets up the writing to be applied to the back of the holy cards in a personalised manner and then inserts the sheet 1*d* in a printing machine 7 for writing, such as a photocopier, or a dot impact, inkjet or laser printer.

As a result, leaving the printer 7 is a sheet 1*e* which has, on its reverse side, a plurality of writings 70 in register with the respective images 3 provided on its front surface.

The protective layer 50, applied to the front surface of the decorative sheet, prevents the gold pigments from becoming detached and thus eliminates the risk of damaging the printer 7.

Lastly, the various holy cards are removed from the sheet 1*e* by breaking the perforated lines 63 and are then given to the end user.

Numerous variations and modifications of detail within the reach of a person skilled in the art can be made to the present embodiment of the invention, without thereby departing from the scope of the invention, as set forth in the appended claims.

The invention claimed is:

1. A process for production of a sheet of image cards comprising:

printing of a sheet so as to obtain a printed sheet with a plurality of images disposed in a plurality of windows, and punching of said printed sheet so as to obtain a punched sheet with microperforations along the perimeter of said windows containing the image, overprinting decorations on said images on said sheet after printing of the images, and depositing a protective layer on said decorations and images on said sheet so as to fix them and avoid removal of material.

2. A process according to claim 1, wherein said overprinting of decorations takes place before said punching.

3. A process according to claim 1, wherein said step of overprinting decorations takes place by hot transfer of decorations from a decorative foil.

4. A process according to claim 1 wherein said decorations comprise one of pigments and flakes of noble metals.

5. A process according to claim 4, wherein the noble metals are selected from the group consisting of gold, silver, and a combination of gold and silver.

6. A process according to claim 1 wherein said protective layer is a transparent varnish which is deposited on the decorations.

7. A process according to claim 6, wherein the varnish is deposited by means selected from the group consisting of spraying, brushes, rollers, and doctor blades, and the varnish is subsequently dried by ultraviolet lamps.

8. A process according to claim 1 wherein said protective layer is a thin transparent film of plastic material.

9. A process according to claim 1 further comprising a step of printing of writing, wherein the writing is printed on the back surface of the punched sheet, in register with each image.

10. A process according to claim 9, wherein said printing step takes place by means selected from the group consisting of a photocopying machine and a printer.

11. A process according to claim 9, wherein the step of printing of writing is performed after depositing the protective layer.

* * * * *

UNITED STATES PATENT AND TRADEMARK OFFICE

CERTIFICATE OF CORRECTION

PATENT NO. : 7,137,337 B2
APPLICATION NO. : 10/820970
DATED : November 21, 2006
INVENTOR(S) : Andrea Bonella et al.

It is certified that error appears in the above-identified patent and that said Letters Patent is hereby corrected as shown below:

On The Title Page, Item (75) Add Inventor:

-- Stephen Panigel, Long Island City, (NY) --.

Signed and Sealed this

Thirteenth Day of February, 2007

JON W. DUDAS
*Director of the United States Patent and Trademark Office*